US005320144A

United States Patent [19]

Ahlers

[11] Patent Number: 5,320,144

[45] Date of Patent: Jun. 14, 1994

[54] METHOD AND AN APPARATUS FOR TREATING REUSABLE BOTTLES OF PLASTIC MATERIAL

[75] Inventor: Egon Ahlers, Neutraubling, Fed. Rep. of Germany

[73] Assignee: Krones AG Hermann Kronseder Maschinenfabrik, Neutraubling, Fed. Rep. of Germany

[21] Appl. No.: 928,490

[22] Filed: Aug. 14, 1992

[30] Foreign Application Priority Data

Aug. 16, 1991 [DE] Fed. Rep. of Germany ..... 4126951

[51] Int. Cl.[5] ..... B65B 1/04

[52] U.S. Cl. ..... 141/1; 141/11; 141/5; 141/114; 141/69

[58] Field of Search ..... 141/114, 82, 83, 92, 141/91, 89, 63, 94, 1, 11, 5, 69

[56] References Cited

U.S. PATENT DOCUMENTS

| | | | |
|---|---|---|---|
| 3,578,038 | 5/1971 | Burford | 141/114 |
| 3,674,060 | 7/1972 | Ruekberg | 141/114 |
| 3,973,603 | 8/1976 | Franz | 141/114 |
| 4,956,033 | 9/1990 | Martin et al. | 15/59 |

*Primary Examiner*—Ernest G. Cusick
*Assistant Examiner*—David J. Walczak
*Attorney, Agent, or Firm*—Finnegan, Henderson, Farabow, Garrett & Dunner

[57] ABSTRACT

By means of a combined heat/internal pressure treatment, reusable bottles of plastic material have their volume enlarged before they are filled. The shrinkage caused by cleaning with a hot cleaning liquid is thus compensated for and the attainable number of cycles is substantially increased.

20 Claims, 1 Drawing Sheet

METHOD AND AN APPARATUS FOR TREATING REUSABLE BOTTLES OF PLASTIC MATERIAL

DESCRIPTION

Figures 1, 2:
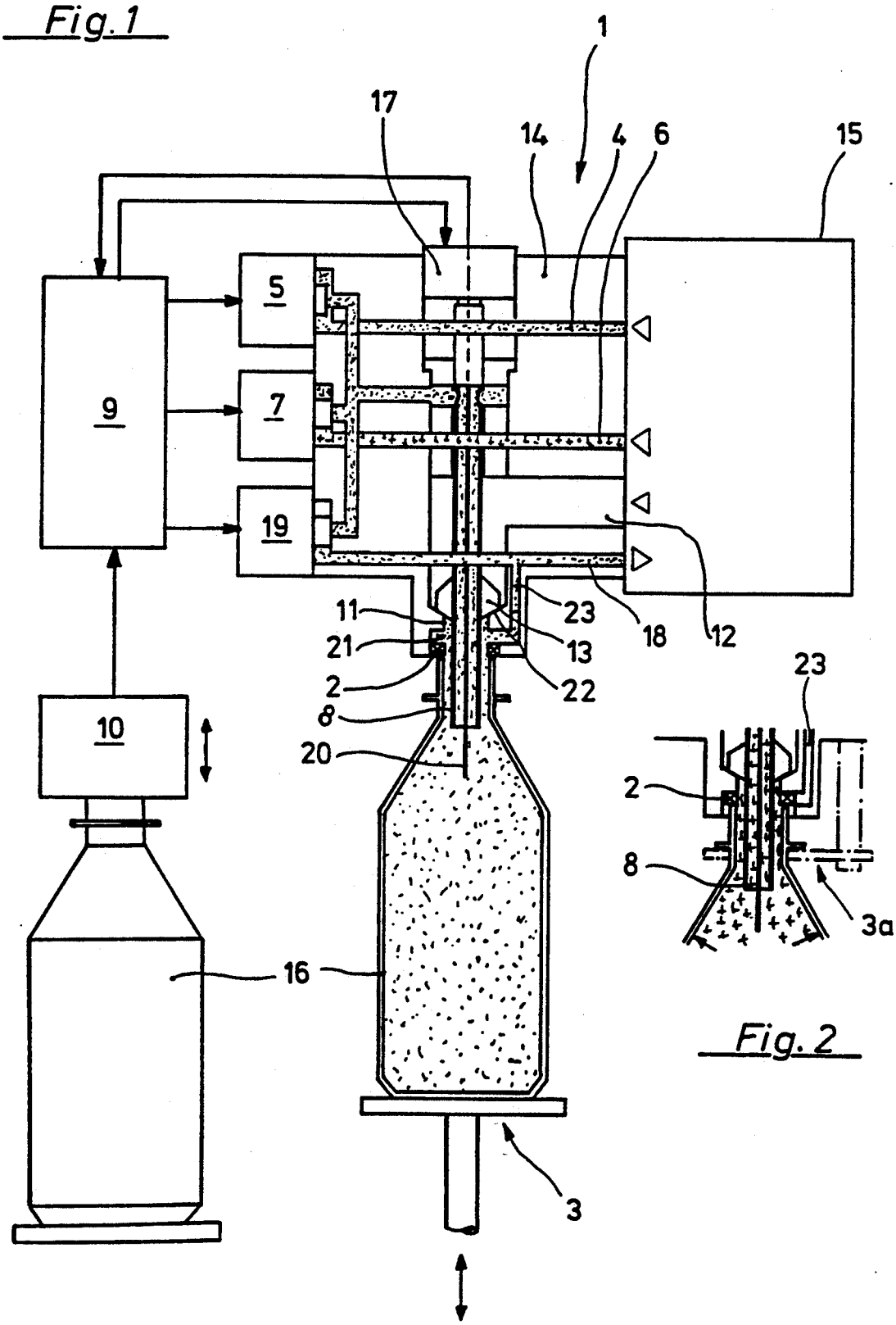

The present invention relates to a method for treating empty reusable bottles of plastic material before they are filled with a beverage as well as an apparatus for carrying out said method.

Similar to reusable bottles consisting of glass, reusable bottles consisting of plastic material must thoroughly be cleaned before they are filled again. Whereas in the case of glass bottles, cleaning liquid temperatures of 80° centigrade and more will not cause any problems at all, the use of such cleaning liquid temperatures in the cleaning of plastic bottles would result in intolerable deformation or even in complete destruction of the bottles. Hence, PET bottles are nowadays treated with a cleaning liquid temperature of approx. 58° centigrade. However, even at this comparatively low temperature, which is just still acceptable with respect to the necessary cleaning effect, slight shrinkage of the bottles will occur. After approx. 20 cycles of a reusable bottle, the volume reduction thus caused reaches an intolerable level so that the bottle in question can no longer be used. Also temperature loads acting on the bottle when it is being transported to or away from the consumer or when it is being used by the consumer will produce the same effect, especially in hot countries and during the summer months. Hence, the numbers of cycles which can be achieved in the case of reusable bottles of plastic material, especially of PET, are much lower than the normal numbers of cycles of glass bottles.

The present invention is based on the task of providing a method for treating reusable bottles of plastic material as well as an apparatus for carrying out said method, by means of which the attainable numbers of cycles or period of use can be increased noticeably.

In accordance with the present invention, this task is solved by subjecting the bottles to an enlargement of volume before they are refilled with a beverage.

By means of the enlargement of the bottle volume effected in accordance with the present invention, the shrinkage caused by cleaning and by other types of influences is compensated for at least approximately. Especially if the enlargement of volume is effected prior to every renewed filling operation, it will easily be possible to double the attainable numbers of cycles.

The enlargement of volume can be carried out with constant parameters for a specific type of bottle so that, on a statistical average, the desired maintenance of a constant content of the bottle, or at least an only slight reduction of the content of the bottle is guaranteed. As an alternative, it is also possible to measure the volumes and/or the dimensions of the bottles and to control the enlargement of volume in accordance with the measured values for a lot of bottles or for each bottle individually. Compensation of bottle shrinkage is thus possible within essentially closer limits. In the simplest case, it will suffice to measure the height and/or the diameter of the bottles.

The enlargement of volume can be carried out at different times and at different locations, e.g. at a collecting point for reusable bottles. It will be particularly expedient, when such enlargement of volume is carried out after cleaning of the bottles by means of a hot cleaning liquid and immediately prior to the filling operation in which the bottles are filled with a beverage or the like within a filling plant for reusable bottles. The shrinkage of the bottles caused by the cleaning process will then be compensated for immediately, and it will be possible to incorporate the enlargement of volume of the bottles into the function of the filling plant.

The enlargement of volume can be carried out while the bottles are transported from a cleaning machine to a filling machine. In this case, a separate station will be required. The enlargement of volume can just as well take place within a filling machine so that a separate station can be dispensed with and so that the additional expenditure required in comparison with a conventional filling plant is kept low.

Independently of the place where and of the time at which the enlargement of volume according to the present invention is carried out, said enlargement of volume results not only in an increase in the numbers of cycles but also in an improvement of the filling accuracy in the case of conventional "level filling" or in an improvement of the outward appearance of the bottles with regard to the filling level in the case of "filling to a prescribed level". Moreover, also the cleaning liquid temperature and, consequently, the cleaning effect can be increased without any disadvantageous consequences.

The enlargement of volume is preferably executed in the presence of heat and excess pressure. These measures can be controlled easily with regard to the decisive parameters at low costs, and they can be adapted to the bottle material in a simple manner. Especially in cases in which steam is used, the additional effect of a sterilization of the interior of the bottle will be obtained. The keeping quality of the bottled liquid can thus be increased essentially.

It will be expedient when, for careful treatment of the bottles, the enlargement of volume is carried out only in the case of the bottles whose content was reduced due to shrinkage, and the enlargement of volume is limited such that the volume achieved will not exceed the nominal content of a bottle in its original condition.

The generation of excess pressure in the interior of the bottle can be combined with the pressurization process of the bottles immediately prior to the introduction of the liquid. The process of volume enlargement is thus so to speak smoothly connected with the actual filling process. The additional expenditure is, consequently, very low.

In the following, an embodiment of the present invention will be described on the basis of the drawings, in which:

FIG. 1 is a schematic representation of an apparatus for treating reusable bottles with steam, FIG. 2 is a fragmentary view of the apparatus according to FIG. 1 during the introduction of overpressure gas.

The apparatus according to FIG. 1 is provided with a filling device 1 having a housing 14, which is attached to the lateral surface of the tank 15 of a rotary counterpressure filling machine, which is not shown in detail. This machine is equipped for filling reusable PET bottles 16—which will be called bottles in the following—with a beverage. The housing 14 has—when seen from the top towards the bottom—formed and arranged therein a supply line 4 for saturated steam (indicated by dots) provided with a control valve 5, a supply line 6 for $CO_2$ under a pressure of 4 bar (indicated by crosses) provided with a control valve 7, a supply line 12 for the beverage provided with a valve 13 and a servomotor 17 as well as a discharge line 18 used for the gas discharged from the bottle 16 and provided with a control valve 19.

The supply lines 4 and 6 as well as the discharge line 18 are connected to the upper end of a gas pipe 8 via their respective control valves, said gas pipe 8 being arranged in the housing 14 such that it is vertically movable therein and being connected to the servomotor 17. The gas pipe 8 projects downwards beyond the housing 14 and carries the valve 13 for the beverage, said valve 13 cooperating with a valve seat 22, which is formed in the housing 14. Said valve seat 22 is followed by a discharge opening 11 for the beverage, which is positioned concentrically with the gas pipe 8. A probe 20, which responds to the liquid level in the bottle 16 and which serves to control the filling operation, is positioned in the interior of the gas pipe 8. An annular chamber 21, which has provided therein a vertically movable sealing ring 2, is formed within said housing 14 below the discharge opening 11. The chamber 21 is connected to the discharge line 18 via a passage 23.

When the sealing ring 2 occupies its lower end position, the connection between the chamber 21 and the discharge passage 18 via passage 23 is open (cf. FIG. 1); when the sealing ring 2 occupies its upper end position, the connection is interrupted (cf. FIG. 2).

The apparatus additionally comprises a lift means 3 for the bottles 16 to be treated, said lift means consisting of a plate for supporting the base of the bottle and of a pneumatic lift cylinder and a control cam, which are not shown in detail. Instead of a plate for receiving thereon the base of the bottle, the lift means can also be provided with an engagement element including a U-shaped recess, which is brought into engagement with the bottle below the carrier ring on the head of the bottle 16. A lift means 3*a* of this type is outlined in FIG. 2.

The control valves 5, 7, 19 and the servomotor 17 are actuated by a control device 9, which has also connected thereto the probe 20. Furthermore, the control device 9 has connected thereto a measuring device 10 for the bottle height and, if desired, for additional parameters, such as leakproofness. The structural design of the measuring device is known e.g. from German-Offenlegungsschrift 37 22 422.

The method for treating bottles 16, which can be carried out by the apparatus described hereinbefore, includes the following steps:

the bottle 16, which comes from a cleaning machine (not shown) and which has been cleaned by soaking and spraying making use of a hot cleaning liquid, is then measured by the measuring device 10 so as to determine its height and its leakproofness is checked. The measured value indicating the height is transmitted to the control device 9; the measured value indicating leakproofness is inputted into a sorting means (not shown) for removing leaking bottles 16.

If the bottle 16 is leakproof, it will be advanced to the rotary counterpressure filling machine, and there a lift means 3 will be used for pressing the bottle onto the sealing ring 2 of the associated filling member 1, said sealing ring 2 occupying its lower end position. If the measuring device 10 has previously ascertained that the respective bottle 16 has the standard height and, consequently, most likely also the standard volume, i.e. that it did not shrink, the control valve 5 remains closed and steam supply does not take place. Alternatively, the control valve 5 may be opened for a short time, approx. 0.5 seconds, for introducing, via the supply line 4 and the gas pipe 8, a short blast of steam into the bottle for the sole purpose of sterilizing the interior of the bottle.

If the measuring device 10 has previously ascertained that the bottle 16 is lower than it should be, the control valve 5 will be opened correspondingly, e.g. in a range of from one to three seconds, by the control device 9 in response to the height difference measured. By means of the saturated steam flowing into the bottle 16 via the supply line 4 and the gas pipe 8 and flowing then out again via the annular chamber 21, the passage 23 and the discharge line 18, the inner surface of the bottle 16 and partially also the wall thereof are sufficiently heated for permitting said bottle 16 to be deformed subsequently. Directly at the surface, the temperature is approx. 100° centigrade, in the interior of the wall it will be correspondingly less. Molecular changes do not take place in the course of this process, and a subsequent excessive extension of the material of the bottle is excluded. While the bottle is being treated with steam, a slight increase in pressure to approx. 1.2 bar will occur within the bottle, said increase in pressure being caused by the flow resistance to the steam. This internal pressure will, however, not suffice to cause a permanent deformation of the bottle 16. When the control valve 5 for the steam has been closed, the hitherto closed control valve 7 for $CO_2$ will be opened. Following this, carbonic acid under a pressure of 4 bar will flow into the interior of the bottle 16 via the supply line 6 and the gas pipe 8, and it will flush the steam together with condensate, which may perhaps have accumulated in the bottle, out of the bottle via the annular chamber 21, the passage 23 and the discharge line 18. Subsequently, the bottle 16 will be raised still further by the lift means 3, in a condition in which the control valve 7 is still open, until the sealing ring 2 occupies its upper end position shown in FIG. 2. An internal pressure of 4 bar will now build up in the bottle 16 in correspondence with the pressure of the $CO_2$. By means of this pressure, which is indicated by arrows in FIG. 2, the bottle wall, which is still warm, will permanently be deformed outwards so as to enlarge its volume. The supply of heat by the steam and the increase in internal pressure caused by the $CO_2$ are coordinated such that the bottle volume will not exceed the original nominal volume, i.e. that excessive extension of the bottle 16 is avoided.

Finally, the beverage to be bottled can be introduced in the bottle 16 by opening the liquid valve 13 via the servomotor 17, the $CO_2$, which previously served to deform the bottle, serving now as a pressurizing gas in the usual way. The filling operation is controlled with the aid of the probe 20 by means of the control device 9, the displaced $CO_2$ being permitted to escape into the open air by opening the control valve 19.

The enlargement of volume which can be achieved by the method described hereinbefore is about 3 milliliters in the case of a conventional reusable PET bottle having a nominal content of 1.5 liters. This enlargement of volume will suffice to compensate for the shrinkage caused by cleaning the bottle. If no measuring device 10 is provided, the control valve 5 will be opened equally long for an average period of e.g. 1.5 seconds in the case of all bottles.

I claim:

1. A method for treating empty, reusable plastic bottles comprising generating an excess pressure in the interior of the bottles to enlarge the volume thereof and thereafter filling the bottles of enlarged volume with a beverage.

2. The method of claim 1, including measuring the volume of the empty, reusable plastic bottles before generating said excess pressure in the bottles, the amount of pressure generated in the bottles and the enlargement of the volumes thereof being controlled in relation to the measured volume of the empty bottles.

3. The method of claim 1, including measuring at least one dimension of the empty, reusable plastic bottles as an indication of the volume thereof before generating said excess pressure in the bottles, the amount of pressure generated in the bottles and the enlargement of the volumes thereof being controlled in relation to the measured dimension of the empty bottles.

4. The method of claims 2 or 3, wherein said bottles have a nominal volume, the pressure being generated only in bottles having a measured volume below said nominal volume.

5. The method of claim 4, wherein the enlargement of the volume of the bottles does not exceed the nominal volume.

6. The method of claim 1, wherein the enlargement of the volume of a bottle is carried out immediately before the bottle is filled with the beverage.

7. The method of claim 1, wherein the enlargement of the volume of a bottle is carried out after cleaning of the bottle with a hot, cleaning liquid.

8. The method of claim 7, wherein the enlargement of the volume of the bottles is carried out while the bottles are being transported from a cleaning machine for cleaning the bottles to a filling machine for filling the bottles.

9. The method of claim 7, wherein the enlargement of the volume of the bottles is carried out in a filling machine for filling the bottle.

10. The method of claim 1, including applying heat t the empty, reusable plastic bottles.

11. The method of claim 10, wherein the application of heat and the generation of the excess pressure in the interior of the bottles take place simultaneously.

12. The method of claim 11, wherein the excess pressure is generated in the interior of the bottles by a hot, pressurized gas.

13. The method of claim 12, wherein steam is used to generate the excess pressure in the bottles.

14. The method of claim 10, wherein the application of heat to the bottles occurs before the generation of the excess pressure in the interior of the bottles.

15. The method of claim 14, wherein a hot gas is first introduced into the interior of the bottles to heat them and, subsequently, a pressurized gas is introduced into the bottles to generate the excess pressure therein.

16. The method of claim 15, wherein the hot gas is removed from the interior of the bottles before the pressurized gas is introduced.

17. The method of claim 12 or 15, including sealing each bottle with respect to the atmosphere in the area of its opening before the pressurized gas is introduced into said bottles.

18. The method of claim 15, wherein steam is used as the hot gas, and air, an inert gas or a mixture of air and an inert gas is used as the pressurized gas.

19. The method of claim 18, wherein carbon dioxide is used as the inert gas.

20. The method of claim 15, wherein the pressurized gas is supplied at a pressure corresponding to the pressure of the filling beverage, the beverage subsequently being filled into the bottle displacing the pressurized gas from the interior thereof.

* * * * *